US009945042B2

(12) United States Patent
Cha et al.

(10) Patent No.: US 9,945,042 B2
(45) Date of Patent: Apr. 17, 2018

(54) CHIP ELECTRONIC COMPONENT AND MANUFACTURING METHOD THEREOF

(71) Applicant: SAMSUNG ELECTRO-MECHANICS CO., LTD., Suwon-Si, Gyeonggi-Do (KR)

(72) Inventors: Hye Yeon Cha, Suwon-Si (KR); Dong Hwan Lee, Suwon-Si (KR); Jung Hyuk Jung, Suwon-Si (KR); Chan Yoon, Suwon-Si (KR); Hye Min Bang, Suwon-Si (KR); Tae Young Kim, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 14/485,402

(22) Filed: Sep. 12, 2014

(65) Prior Publication Data

US 2015/0270053 A1 Sep. 24, 2015

(30) Foreign Application Priority Data

Mar. 18, 2014 (KR) ..... 10-2014-0031377

(51) Int. Cl.
*H01F 27/28* (2006.01)
*H01F 5/00* (2006.01)
(Continued)

(52) U.S. Cl.
CPC ..... *C25D 7/001* (2013.01); *C25D 5/02* (2013.01); *C25D 5/10* (2013.01); *C25D 5/16* (2013.01);
(Continued)

(58) Field of Classification Search
CPC ..... H01F 27/2804; H01F 27/29; H01F 2027/2809; C25D 7/00; C25D 7/001
(Continued)

(56) References Cited

U.S. PATENT DOCUMENTS 5,124,175 A * 6/1992 Miracky ..... H05K 1/0293 216/13
6,469,609 B2 * 10/2002 Lee ..... H01F 5/003 29/602.1
(Continued)

FOREIGN PATENT DOCUMENTS

CN 1523617 A 8/2004
CN 101046482 A 10/2007
(Continued)

OTHER PUBLICATIONS

Chinese Office Action dated Nov. 1, 2016 issued in Chinese Patent Application No. 20140330931.8 (with English translation).
(Continued)

*Primary Examiner* — Mangtin Lian
(74) *Attorney, Agent, or Firm* — McDermott Will & Emery LLP

(57) ABSTRACT

There are provided a chip electronic component and a manufacturing method thereof, and more particularly, a chip electronic component having an internal coil structure capable of preventing the occurrence of short-circuits between coil portions and having a high aspect ratio (AR) by increasing a thickness of a coil as compared to a width of the coil, and a manufacturing method thereof.

12 Claims, 5 Drawing Sheets

(51) Int. Cl.

| | |
|---|---|
| ***H01F 27/24*** | (2006.01) |
| ***C25D 7/00*** | (2006.01) |
| ***H01F 17/00*** | (2006.01) |
| ***H01F 17/04*** | (2006.01) |
| ***H01F 27/29*** | (2006.01) |
| ***H01F 41/04*** | (2006.01) |
| ***C25D 5/02*** | (2006.01) |
| ***C25D 5/10*** | (2006.01) |
| ***C25D 5/16*** | (2006.01) |

(52) U.S. Cl.
CPC ..... *H01F 17/0013* (2013.01); *H01F 17/04* (2013.01); *H01F 27/292* (2013.01); *H01F 41/046* (2013.01)

(58) Field of Classification Search
USPC ..... 336/192, 200, 223, 83, 233; 205/119
See application file for complete search history.

(56) References Cited

U.S. PATENT DOCUMENTS 6,600,404 B1 * 7/2003 Kajino ..... H01F 5/003 257/531
7,759,776 B2 * 7/2010 Cheng ..... G01R 1/07378 257/659
2002/0105405 A1 8/2002 Lee et al.
2004/0164835 A1 8/2004 Shoji
2006/0022787 A1 * 2/2006 Brennan ..... H01F 17/0006 336/200
2007/0235873 A1 10/2007 Cheng
2012/0068301 A1 * 3/2012 Sin ..... H01L 23/645 257/531
2013/0335186 A1 * 12/2013 Chang ..... H01F 5/003 336/200
2014/0009254 A1 * 1/2014 Ohkubo ..... H01F 27/2804 336/192
2014/0043129 A1 2/2014 Wi et al.
2015/0035640 A1 * 2/2015 Wang ..... H01F 17/0006 336/200

FOREIGN PATENT DOCUMENTS

| | | | |
|---|---|---|---|
| CN | 103578721 | A | 2/2014 |
| JP | 10-241983 | A | 9/1998 |
| JP | 2004-319570 | A | 11/2004 |
| JP | 2004-342645 | A | 12/2004 |
| JP | 2006-278479 | A | 10/2006 |
| JP | 2006-310705 | A | 11/2006 |

OTHER PUBLICATIONS

Chinese Office Action dated Jul. 3, 2017 issued in Chinese Patent Application No. 201410330931.8 (with English translation).

* cited by examiner

CHIP ELECTRONIC COMPONENT AND MANUFACTURING METHOD THEREOF

CROSS-REFERENCE TO RELATED APPLICATION

This application claims the benefit of Korean Patent Application No. 10-2014-0031377 filed on Mar. 18, 2014, with the Korean Intellectual Property Office, the disclosure of which is incorporated herein by reference.

BACKGROUND

The present disclosure relates to a chip electronic component and a manufacturing method thereof.

An inductor, one of chip electronic components, is a typical passive element forming an electronic circuit together with a resistor and a capacitor to remove noise. Such an inductor may be combined with the capacitor using electromagnetic characteristics to configure a resonance circuit amplifying a signal in a specific frequency band, a filter circuit, or the like.

Recently, as the trend for the miniaturization and thinning of Information Technology (IT) devices such as various communications devices, display devices, and the like, has grown, research into technologies for miniaturizing and thinning various elements such as inductors, capacitors, transistors, and the like, used in the IT devices, has been continuously undertaken. The inductor has also been rapidly replaced by a chip having a small size and high density and capable of being automatically surface-mounted, and the development of a thin type inductor formed by mixing a magnetic powder with a resin and applying the mixture to coil patterns formed on upper and lower surfaces of a thin film insulating substrate through plating has been conducted.

A direct current (DC) resistance Rdc, main properties of the inductor, may be decreased in accordance with an increase in a cross-sectional area of a coil. Therefore, in order to decrease the direct current resistance Rdc and improve inductance, a cross-sectional area of an internal coil of the inductor needs to be increased.

Methods of increasing the cross-sectional area of the coil may include, two methods, that is, a method of increasing a width of the coil and a method of increasing a thickness of the coil.

In the case of increasing the width of the coil, a possibility in which short-circuits may occur between coil portions may be increased and the number of turns capable of being implemented in an inductor chip may be restricted to cause a decrease in an area occupied by a magnetic material, such that a decrease in efficiency may be caused, and the implementation of a high inductance product may be limited.

Therefore, in the internal coil of the thin type inductor, a structure having a high aspect ratio (AR) by increasing the thickness of the coil has been required. The aspect ratio (AR) of the internal coil means a value obtained by dividing the thickness of the coil by the width of the coil. Therefore, the aspect ratio (AR) may increase as an increasing amount of the thickness of the coil is greater than an increasing amount of the width of the coil.

In order to implement the high aspect ratio (AR) of the internal coil, growth of the coil in a width direction needs to be suppressed, and growth of the coil in a thickness direction needs to be accelerated.

According to the related art, at the time of performing a pattern plating method using a plating resist, the plating resist needs to have a large thickness in order to form a coil having a large thickness. However, in this case, since the plating resist needs to have a predetermined width or more in order to maintain its form, an interval between coil portions may be increased.

In addition, at the time of performing an electroplating method according to the related art, short-circuits occur between coil portions and a limitation in implementing a high aspect ratio (AR) may be present, due to an isotropic growth phenomenon in which a coil is grown in a width direction thereof as well as in a thickness direction thereof.

RELATED ART DOCUMENT p0 (Patent Document 1) Japanese Patent Laid-Open Publication No. 2006-278479

SUMMARY

An aspect of the present disclosure may provide a chip electronic component having a structure capable of preventing the occurrence of short-circuits between coil portions and implementing a high aspect ratio (AR) by increasing a thickness of a coil as compared to a width of the coil, and a manufacturing method thereof.

According to an aspect of the present disclosure, a chip electronic component may include: a magnetic body including an insulating substrate; an internal coil part formed on at least one surface of the insulating substrate; and an external electrode formed on one end surface of the magnetic body and connected to the internal coil part, wherein the internal coil part includes a first coil pattern formed on the insulating substrate, a second coil pattern formed to cover the first coil pattern, and a third coil pattern formed on the second coil pattern.

The second coil pattern may be formed such that the second coil pattern is grown in a width direction and a thickness direction.

The third coil pattern may be formed such that the third coil pattern is grown only in a thickness direction.

The second coil pattern may be formed by isotropic plating, and the third coil pattern may be formed by anisotropic plating.

When a thickness of the second coil pattern from the one surface of the insulating substrate to a plating line of the second coil pattern is defined as A and a thickness of the third coil pattern from the plating line of the second coil pattern to a plating line of the third coil pattern is defined as B, B/A may be 0.1 to 20.0.

The internal coil part may contain one or more selected from a group consisting of silver (Ag), palladium (Pd), aluminum (Al), nickel (Ni), titanium (Ti), gold (Au), copper (Cu), and platinum (Pt).

The first coil pattern, the second coil pattern, and the third coil pattern may be formed of the same metal.

An aspect ratio of the internal coil part may be 1.2 or more.

According to another aspect of the present disclosure, a chip electronic component may include: a magnetic body including an insulating substrate; an internal coil part formed on at least one surface of the insulating substrate; and an external electrode formed on one end surface of the magnetic body and connected to the internal coil part, wherein the internal coil part includes a pattern-plated layer formed on the insulating substrate, an isotropically plated layer covering the pattern-plated layer, and an anisotropically plated layer formed on the isotropically plated layer.

When a thickness of the isotropically plated layer from the one surface of the insulating substrate to a plating line of the isotropically plated layer is defined as A and a thickness of the anisotropically plated layer from the plating line of the isotropically plated layer to a plating line of the anisotropically plated layer is defined as B, B/A may be 0.1 to 20.0.

According to another aspect of the present disclosure, a manufacturing method of a chip electronic component may include: forming an internal coil part on at least one surface of an insulating substrate; stacking magnetic layers on upper and lower portions of the insulating substrate on which the internal coil part is formed, to form a magnetic body; and forming an external electrode on at least one end surface of the magnetic body to be connected to the internal coil part, wherein the forming of the internal coil part includes forming a first coil pattern on the insulating substrate, forming a second coil pattern to cover the first coil pattern, and forming a third coil pattern on the second coil pattern.

The forming of the first coil pattern may include forming a plating resist having an opening for forming the first coil pattern on the insulating substrate, filling the opening for forming the first coil pattern to form the first coil pattern, and removing the plating resist.

The second coil pattern may be formed by performing isotropic electroplating on the first coil pattern.

The third coil pattern may be formed by performing anisotropic electroplating on the second coil pattern.

When a thickness of the second coil pattern from the one surface of the insulating substrate to a plating line of the second coil pattern is defined as A and a thickness of the third coil pattern from the plating line of the second coil pattern to a plating line of the third coil pattern is defined as B, B/A may be 0.1 to 20.0.

The internal coil part may contain one or more selected from a group consisting of silver (Ag), palladium (Pd), aluminum (Al), nickel (Ni), titanium (Ti), gold (Au), copper (Cu), and platinum (Pt).

An aspect ratio of the internal coil part may be 1.2 or more.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
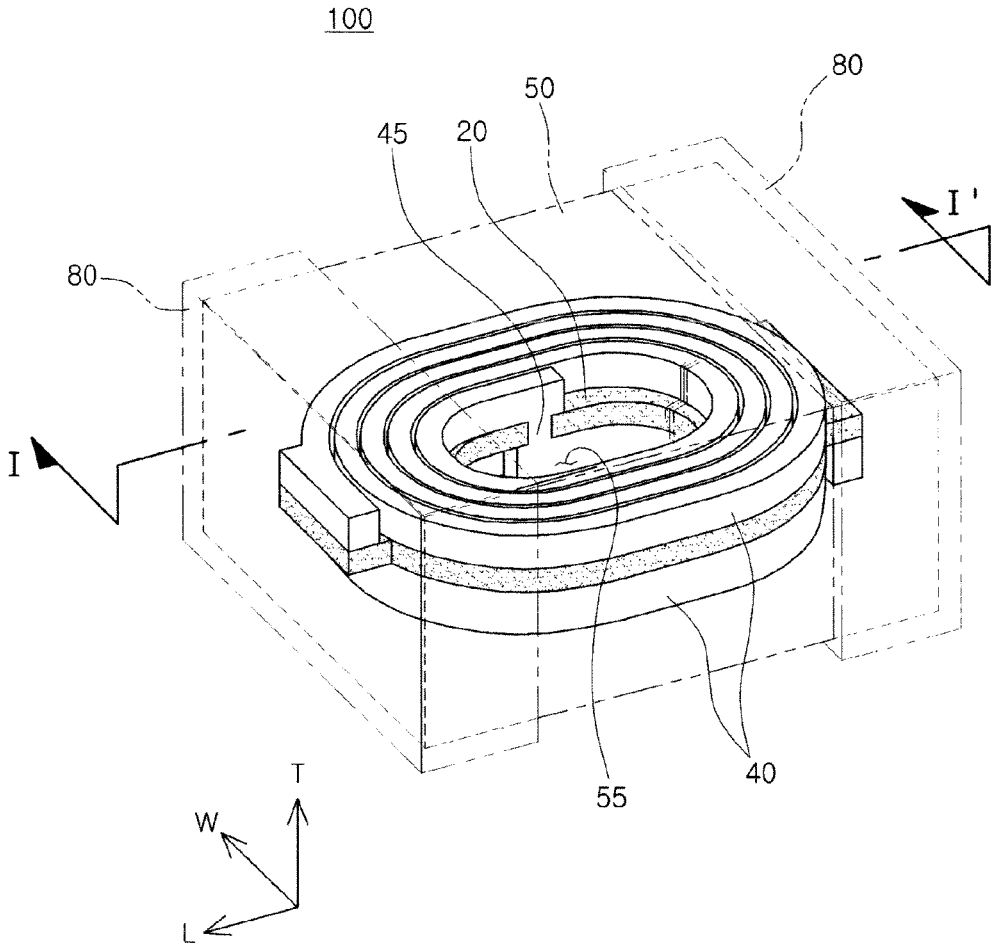
FIG. 1 is a schematic perspective view illustrating a chip electronic component according to an exemplary embodiment of the present disclosure, in which internal coil parts are shown.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Hereinafter, a chip electronic component according to an exemplary embodiment of the present disclosure will be described. Particularly, a thin type inductor will be described, but the present disclosure is not limited thereto.

Figure 2:
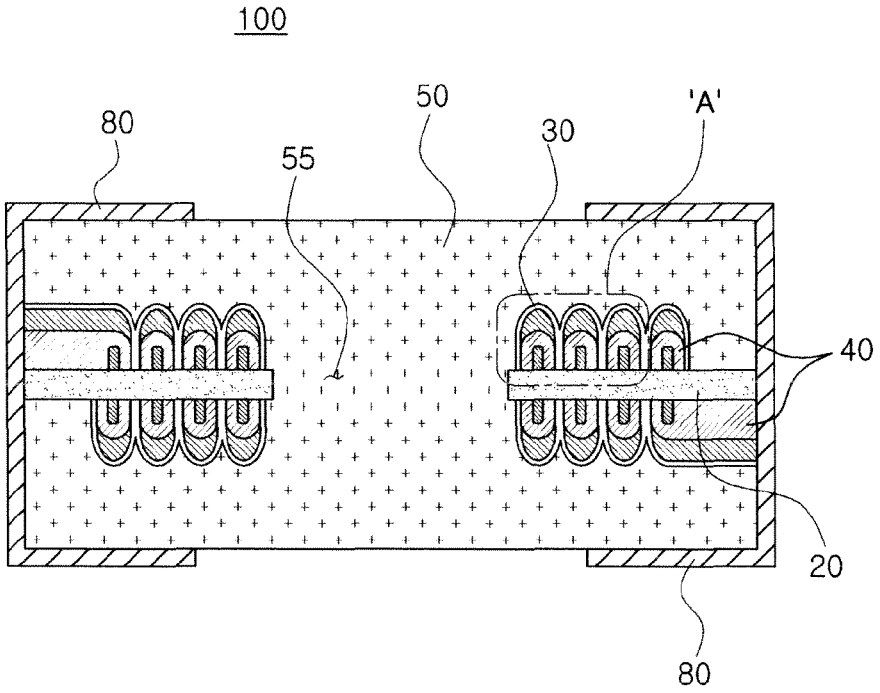
FIG. 2 is a cross-sectional view taken along line I-I' of FIG. 1.
Figure 3:
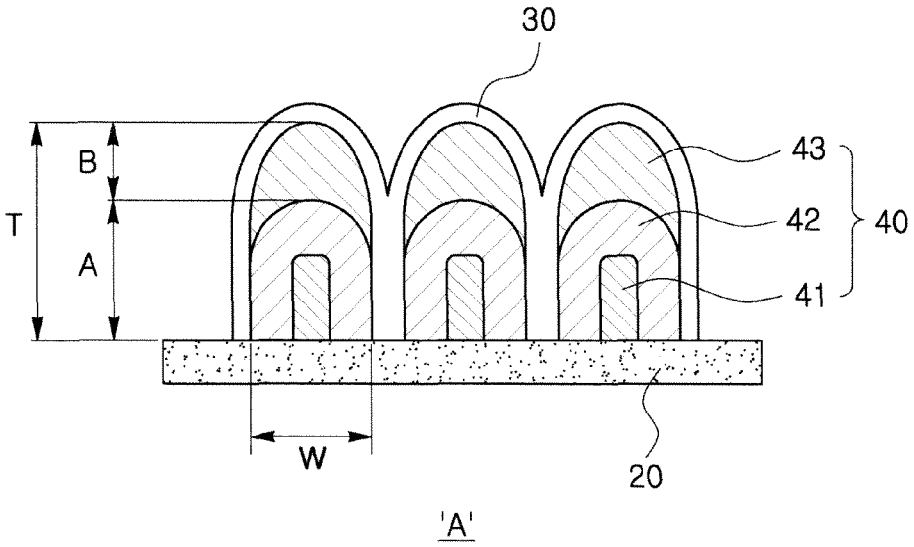
FIG. 3 is an enlarged schematic view illustrating an example of part A of FIG. 2.

FIG. 1 is a schematic perspective view illustrating a chip electronic component according to an exemplary embodiment of the present disclosure, in which internal coil parts are shown. FIG. 2 is a cross-sectional view taken along line I-I' of FIG. 1. FIG. 3 is a schematic enlarged view illustrating an example of part A of FIG. 2.

Referring to FIGS. 1 and 2, as an example of the chip electronic component, a thin type inductor 100 provided in the form of a chip and used in a power line of a power supply circuit is disclosed. As the chip electronic component, a chip bead, a chip filter, or the like, in addition to the chip inductor, may be appropriately used.

The thin type inductor 100 may include a magnetic body 50, an insulating substrate 20, internal coil parts 40, and external electrodes 80.

The magnetic body 50 may form the exterior of the thin type inductor 100 and may be formed of any material capable of exhibiting magnetic properties. For example, the magnetic body 50 may be formed by filling a ferrite material or a metal-based soft magnetic material.

The ferrite material may be a ferrite material commonly known in the art such as Mn—Zn based ferrite, Ni—Zn based ferrite, Ni—Zn—Cu based ferrite, Mn—Mg based ferrite, Ba based ferrite, Li based ferrite, or the like.

The metal-based soft magnetic material may be an alloy containing at least one selected from a group consisting of Fe, Si, Cr, Al, and Ni. For example, the metal-based soft magnetic material may include Fe—Si—B—Cr based amorphous metal particles, but is not limited thereto.

The metal-based soft magnetic material may have a particle diameter of 0.1 to 20 μm and may be contained in a fain in which particles are dispersed on a polymer such as an epoxy resin, polyimide, or the like.

The magnetic body 50 may have a hexahedral shape. Directions of a hexahedron will be defined in order to clearly describe an exemplary embodiment of the present disclosure. L, W and T shown in FIG. 1 refer to a length direction, a width direction, and a thickness direction, respectively. The magnetic body 50 may have a rectangular parallelepiped shape in which a length thereof is larger than a width thereof.

The insulating substrate 20 formed in the magnetic body 50 may be, for example, a polypropylene glycol (PPG) substrate, a ferrite substrate, a metal-based soft magnetic substrate, or the like.

The insulating substrate 20 may have a through hole penetrating through a central portion thereof, and the through hole may be filled with a magnetic material such as ferrite, a metal-based soft magnetic material, or the like, to form a core part 55. The core part 55 filled with the magnetic material may be formed, thereby increasing inductance L.

The internal coil part 40 having a coil-shaped pattern may be formed on one surface of the insulating substrate 20, and the internal coil part 40 having a coil-shaped pattern may also be formed on the other surface of the insulating substrate 20.

The internal coil parts 40 may include coil patterns formed in a spiral shape, and the internal coil parts 40 formed on one surface and the other surface of the insulating substrate 20 may be electrically connected to each other through a via electrode 45 formed in the insulating substrate 20.

Referring to FIG. 3, each of the internal coil parts 40 may include a first coil pattern 41 formed on the insulating substrate 20, a second coil pattern 42 formed to cover the first coil pattern 41, and a third coil pattern 43 formed on the second coil pattern 42.

The first coil pattern 41 may be a pattern-plated layer formed by forming a patterned plating resist on the insulating substrate 20 and filling an opening with a conductive metal.

The second coil pattern 42 may be formed by performing electroplating and may be an isotropically plated layer having a shape in which it is grown in both of a width direction W and a thickness direction T.

The third coil pattern 43 may be formed by performing electroplating and may be an anisotropically plated layer having a shape in which it is grown only in the thickness direction T while growth thereof in the width direction W is suppressed.

A current density, a concentration of a plating solution, a plating speed, and the like, may be adjusted, such that the second coil pattern 42 may be formed as an isotropically plated layer and the third coil pattern 43 may be formed as an anisotropically plated layer.

As described above, the first coil pattern 41 which is the pattern-plated layer is formed on the insulating substrate 20, the second coil pattern 42 which is the isotropically plated layer covering the first coil pattern 41 is formed, and the third coil pattern 43 which is the anisotropically plated layer, is formed on the second coil pattern 42, such that the occurrence of short-circuits between coil portions may be prevented while growth of the coil in the thickness direction may be accelerated to implement the internal coil part 40 having a high aspect ratio (AR), for example, an aspect ratio AR (T/W) of 1.2 or more.

When a thickness of the second coil pattern 42 from one surface of the insulating substrate 20 to a plating line of the second coil pattern 42 is defined as A and a thickness of the third coil pattern 43 from the plating line of the second coil pattern 42 to a plating line of the third coil pattern 43 is defined as B, B/A may be 0.1 to 20.0.

The plating line of the second coil pattern 42 or the third coil pattern 43 may refer to an interface observable on a cross-section of the internal coil part 40, and the thickness A may refer to a distance from one surface of the insulating substrate 20 to the highest position of the plating line of the second coil pattern 42, and the thickness B may refer to a distance from the highest position of the plating line of the second coil pattern 42 to the highest position of the plating line of the third coil pattern 43.

In a case in which B/A is less than 0.1, defects such as short-circuits between the coil portions may occur due to isotropic growth of the second coil pattern and a limitation may be present in improving an aspect ratio (AR) of the coil.

Meanwhile, in order to form the internal coil part 40 such that B/A exceeds 20.0, the third coil pattern 43, the anisotropically plated layer, needs to be highly grown. However, since a cross-sectional area of the coil may be continuously changed during a plating process, it may be difficult to continuously perform anisotropic plating for a long time, such that forming the internal coil part 40 in such a manner that B/A exceeds 20.0 may be restricted and a manufacturing cost may be increased.

The internal coil part 40 may be formed of a metal having excellent electrical conductivity, for example, silver (Ag), palladium (Pd), aluminum (Al), nickel (Ni), titanium (Ti), gold (Au), copper (Cu), or platinum (Pt), an alloy thereof, or the like.

The first coil pattern 41, the second coil pattern 42, and the third coil pattern 43 may be formed of the same metal, preferably, copper (Cu).

The internal coil part 40 may be coated with an insulating layer 30.

The insulating layer 30 may be formed by a method known in the art such as a screen printing method, an exposure and development method of photoresist (PR), a spray applying method, or the like. The internal coil part 40 may be coated with the insulating layer 30, such that it does not directly contact the magnetic material configuring the magnetic body 50.

One end portion of the internal coil part 40 formed on one surface of the insulating substrate 20 may be exposed to one end surface of the magnetic body 50 in the length direction, and one end portion of the internal coil part 40 formed on the other surface of the insulating substrate 20 may be exposed to the other end surface of the magnetic body 50 in the length direction.

The external electrodes 80 may be formed on both end surfaces of the magnetic body 50 in the length direction thereof, respectively, to be connected to the internal coil parts 40 exposed to the both end surfaces of the magnetic body 50 in the length direction thereof. The external electrodes 80 may be extended to both surfaces of the magnetic body 50 in the thickness direction thereof and/or both surfaces of the magnetic body 50 in the width direction thereof.

The external electrode 80 may be formed of a metal having excellent electrical conductivity, for example, nickel (Ni), copper (Cu), tin (Sn), silver (Ag), or the like, alone, or an alloy thereof, and the like.

Manufacturing Method of Chip Electronic Component

Figure 4:
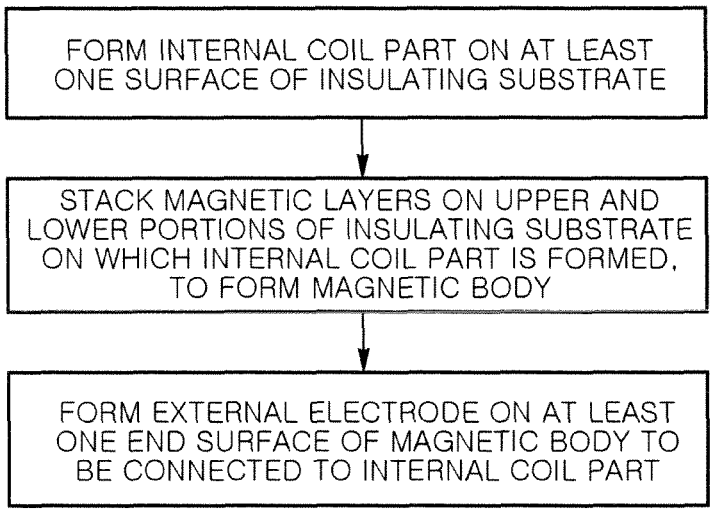
FIG. 4 is a flowchart illustrating a manufacturing method of a chip electronic component according to an exemplary embodiment of the present disclosure.

FIG. 4 is a flow chart illustrating a manufacturing method of a chip electronic component according to an exemplary embodiment of the present disclosure. FIGS. 5 through 9 are views sequentially illustrating the manufacturing method of the chip electronic component according to an exemplary embodiment of the present disclosure.

Referring to FIG. 4, first, the internal coil part 40 may be formed at least one surface of the insulating substrate 20.

The insulating substrate 20 is not particularly limited, but may be, for example, a polypropylene glycol (PPG) substrate, a ferrite substrate, a metal-based soft magnetic substrate, or the like, and may have a thickness of 40 to 100 μm.

Figure 5:
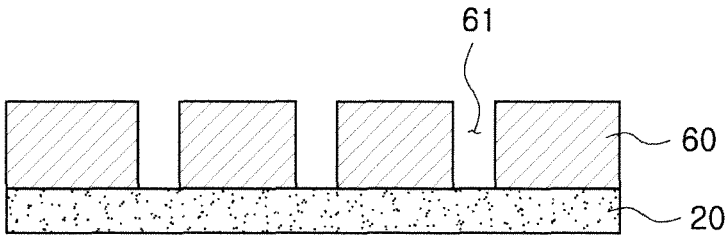
FIGS. 5 through 9 are views sequentially illustrating the manufacturing method of the chip electronic component according to an exemplary embodiment of the present disclosure.

Next, a process of forming the internal coil part 40 will be described. Referring to FIG. 5, a plating resist 60 having openings 61 for forming the first coil pattern may be formed on the insulating substrate 20.

The plating resist 60, a general photosensitive resist film, may be a dry film resist, or the like, but is not limited thereto.

Figure 6:
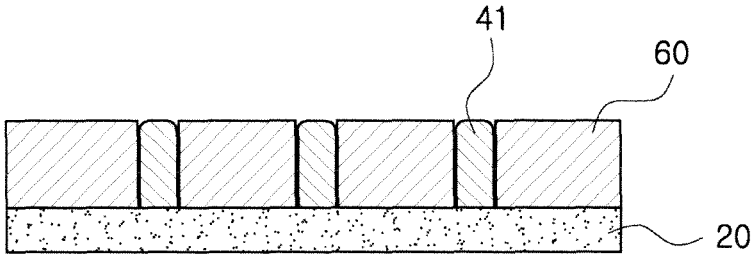

Referring to FIG. 6, the first coil pattern 41 may be formed by applying an electroplating process, or the like, to the openings 61 for forming first coil pattern to fill the openings with an electric conductive metal.

The first coil pattern 41 may be formed of a metal having excellent electrical conductivity, for example, silver (Ag), palladium (Pd), aluminum (Al), nickel (Ni), titanium (Ti), gold (Au), copper (Cu), or platinum (Pt), a mixture thereof, or the like.

Figure 7:
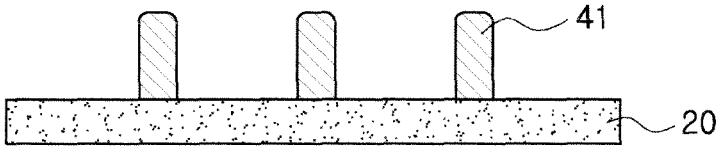

Referring to FIG. 7, the plating resist 60 may be removed by a process such as a chemical etching process, or the like.

When the plating resist 60 is removed, the first coil pattern 41, which is the pattern-plated layer, may remain on the insulating substrate 20.

Figure 8:
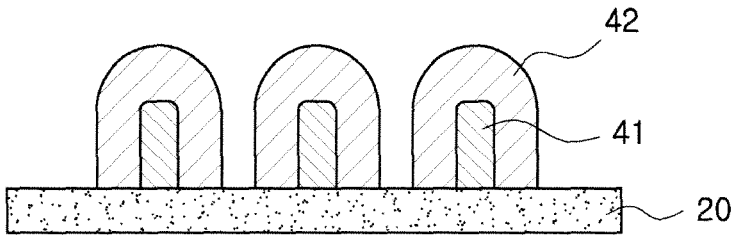

Referring to FIG. 8, the second coil pattern 42 covering the first coil pattern 41 may be formed by performing electroplating on the first coil pattern 41.

A current density, a concentration of a plating solution, a plating speed, and the like, may be adjusted at the time of performing the electroplating, such that the second coil pattern 42 may be formed of an isotropically plated layer having a shape in which it is grown in both of the width direction W and the thickness direction T.

Figure 9:
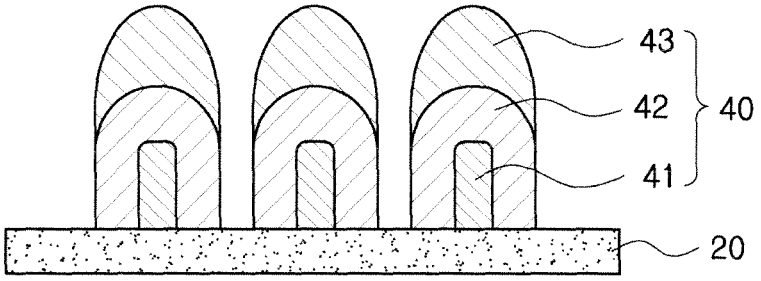

Referring to FIG. 9, the third coil pattern 43 may be formed by performing electroplating on the second coil pattern 42.

A current density, a concentration of a plating solution, a plating speed, and the like, may be adjusted at the time of performing the electroplating, such that the third coil pattern 43 may be formed of an anisotropically plated layer having a shape in which it is grown only in the thickness direction T while growth thereof in the width direction W is suppressed.

As described above, the first coil pattern 41 which is the pattern-plated layer is formed on the insulating substrate 20, the second coil pattern 42 which is the isotropically plated layer covering the first coil pattern 41 is formed, and the third coil pattern 43 which is the anisotropically plated layer, is formed on the second coil pattern 42, such that the occurrence of short-circuits between coil portions may be prevented while growth of the coil in the thickness direction may be accelerated to implement the internal coil part 40 having a high aspect ratio (AR), for example, an aspect ratio AR (T/W) of 1.2 or more.

When a thickness of the second coil pattern 42 from one surface of the insulating substrate 20 to a plating line of the second coil pattern 42 is defined as A and a thickness of the third coil pattern 43 from the plating line of the second coil pattern 42 to a plating line of the third coil pattern 43 is defined as B, B/A may be 0.1 to 20.0.

In a case in which B/A is less than 0.1, defects such as short-circuits between the coil portions may occur due to isotropic growth of the second coil pattern and a limitation may be present in improving an aspect ratio (AR) of the coil. Meanwhile, in order to form the internal coil part 40 such that B/A exceeds 20.0, the third coil pattern 43, the anisotropically plated layer, needs to be highly grown. However, since a cross-sectional area of the coil may be continuously changed during a plating process, it may be difficult to continuously perform anisotropic plating for a long time, such that forming the internal coil part 40 in such a manner that B/A exceeds 20.0 may be restricted and a manufacturing cost may be increased.

The second and third coil patterns 42 and 43 may be formed of a metal having excellent electrical conductivity, for example, silver (Ag), palladium (Pd), aluminum (Al), nickel (Ni), titanium (Ti), gold (Au), copper (Cu), or platinum (Pt), a mixture thereof, or the like.

The first coil pattern 41, the second coil pattern 42, and the third coil pattern 43 may be formed of the same metal, preferably, copper (Cu)

The via electrode 45 may be formed by forming a hole in a portion of the insulating substrate 20 and filling the hole with a conductive material, and the internal coil part 40 formed on one surface and the internal coil part 40 formed on the other surface of the insulating substrate 20 may be electrically connected to each other through the via electrode 45.

A hole penetrating through the insulating substrate 20 may be formed in a central portion of the insulating substrate 20 by performing a drilling process, a laser process, a sandblasting process, or a punching process, or the like, on the central portion of the insulating substrate 20.

After the internal coil part 40 is formed, the insulating layer 30 coating the internal coil part 40 may be formed. The insulating layer 30 may be formed by a method known in the art such as a screen printing method, an exposure and development method of photoresist (PR), a spray applying method, or the like, but the present disclosure is not limited thereto.

Next, magnetic layers may be stacked on upper and lower portions of the insulating substrate 20 on which the internal coil part 40 is formed, to form the magnetic body 50.

The magnetic body 50 may be formed by stacking magnetic layers on both surfaces of the insulating substrate 20 and pressing the stacked magnetic layers by a lamination method or an isostatic pressing method. In this case, the core part 55 may be formed such that the hole may be filled with the magnetic material.

Next, the external electrode 80 may be formed to be connected to the internal coil part 40 exposed to at least one end surface of the magnetic body 50.

The external electrode 80 may be formed of a paste containing a metal having excellent electrical conductivity, for example, a conductive paste containing nickel (Ni), copper (Cu), tin (Sn), or silver (Ag) alone, or an alloy thereof. The external electrode 80 maybe formed by a dipping method, or the like, in addition to a printing method, according to a shape of the external electrode.

A description of features that are the same as those of the chip electronic component according to an exemplary embodiment of the present disclosure described above will be omitted.

As set forth above, in the chip electronic component according to exemplary embodiments of the present disclosure, an internal coil structure capable of preventing the occurrence of short-circuits between coil portions and having a high aspect ratio (AR) by increasing a thickness of a coil as compared to a width of the coil may be implemented.

Therefore, a cross-sectional area of the coil may be increased, direct current (DC) resistance (Rdc) may be decreased, and inductance may be improved.

While exemplary embodiments have been shown and described above, it will be apparent to those skilled in the art that modifications and variations could be made without departing from the spirit and scope of the present disclosure as defined by the appended claims.

What is claimed is:

1. A chip electronic component comprising:

a magnetic body including an insulating substrate;

an internal coil part formed on at least one surface of the insulating substrate; and an external electrode formed on one end surface of the magnetic body and connected to the internal coil part, wherein the internal coil part includes a first coil pattern formed on the insulating substrate, a second coil pattern formed to cover the first coil pattern, and a third coil pattern formed on the second coil pattern, wherein the second coil pattern covers upper and side surfaces of the first coil pattern, and the third coil pattern is disposed on an upper surface of the second coil pattern, such that at least a portion of a side surface of the second coil pattern is not covered by the third coil pattern, wherein the magnetic body includes Fe-Si-B-Cr-based amorphous metal particles dispersed in an epoxy resin or polyimide, wherein the Fe-Si-B-Cr-based amorphous metal particles have a particle diameter of 0.1 to 20 μm.

2. The chip electronic component of claim 1, wherein the second coil pattern is formed such that the second coil pattern is grown in a width direction and a thickness direction.

3. The chip electronic component of claim 1, wherein the third coil pattern is formed such that the third coil pattern is grown only in a thickness direction.

4. The chip electronic component of claim 1, wherein the third coil pattern is formed to extend the internal coil part only in the thickness direction.

5. The chip electronic component of claim 1, wherein when a thickness of the second coil pattern from the one surface of the insulating substrate to a plating line of the second coil pattern is defined as A and a thickness of the third coil pattern from the plating line of the second coil pattern to a plating line of the third coil pattern is defined as B, B/A is 0.1 to 20.0.

6. The chip electronic component of claim 1, wherein the internal coil part contains one or more selected from a group consisting of silver (Ag), palladium (Pd), aluminum (Al), nickel (Ni), titanium (Ti), gold (Au), copper (Cu), and platinum (Pt).

7. The chip electronic component of claim 1, wherein the first coil pattern, the second coil pattern, and the third coil pattern are formed of the same metal.

8. The chip electronic component of claim 1, wherein an aspect ratio of the internal coil part is 1.2 or more.

9. The chip electronic component of claim 1, wherein the side surface of the second coil pattern is perpendicular to the surface of the insulating substrate on which the internal coil part is formed.

10. A chip electronic component comprising:

a magnetic body including an insulating substrate;

an internal coil part formed on at least one surface of the insulating substrate; and an external electrode formed on one end surface of the magnetic body and connected to the internal coil part, wherein the internal coil part includes a pattern layer formed on the insulating substrate, a first plate layer covering the pattern layer, and a second plate layer formed on the first plate layer, and wherein the first plate layer covers upper and side surfaces of the pattern layer, and the second plate layer is disposed on an upper surface of the first plate layer such that at least a portion of a side surface of the first plate layer is not covered by the second plate layer, wherein the magnetic body includes Fe-Si-B-Cr-based amorphous metal particles dispersed in an epoxy resin or polyimide, and wherein the Fe-Si-B-Cr-based amorphous metal particles have a particle diameter of 0.1 to 20 μm.

11. The chip electronic component of claim 10, wherein when a thickness of the first plate layer from the one surface of the insulating substrate to a plating line of the first plate layer is defined as A and a thickness of the second plate layer from the plating line of the first plate layer to a plating line of the second plate layer is defined as B, B/A is 0.1 to 20.0.

12. The chip electronic component of claim 10, wherein the side surface of the first plate layer is perpendicular to the surface of the insulating substrate on which the internal coil part is formed.

* * * * *